US005666994A

United States Patent [19]

Stoll et al.

[11] Patent Number: 5,666,994

[45] Date of Patent: Sep. 16, 1997

[54] VALVE ARRANGEMENT

[75] Inventors: Kurt Stoll; Manfred Rüdle, both of Esslingen, Germany

[73] Assignee: Festo KG, Esslingen, Germany

[21] Appl. No.: 423,002

[22] Filed: Apr. 13, 1995

[30] Foreign Application Priority Data

Apr. 20, 1994 [DE] Germany ..... 44 13 657.9

[51] Int. Cl.[6] ..... F15B 13/043; F15B 13/08

[52] U.S. Cl. ..... 137/625.64; 137/596.16; 137/884

[58] Field of Search ..... 137/596.16, 625.64, 137/884

[56] References Cited

U.S. PATENT DOCUMENTS

| | | | |
|---|---|---|---|
| 3,771,565 | 11/1973 | Padula | 137/625.64 |
| 4,067,357 | 1/1978 | Ruchser . | |
| 4,257,572 | 3/1981 | Neff . | |
| 4,726,393 | 2/1988 | Herner . | |
| 4,736,773 | 4/1988 | Perry et al. | 137/625.64 |

FOREIGN PATENT DOCUMENTS

| | | | |
|---|---|---|---|
| 0116500 | 8/1984 | European Pat. Off. . | |
| 151330 | 8/1985 | European Pat. Off. | 137/625.69 |
| 24 43 981 | 4/1976 | Germany . | |
| 3510283 | 9/1985 | Germany . | |
| 3701211 | 8/1987 | Germany . | |
| 3919413 | 12/1990 | Germany . | |
| 4020024 | 1/1992 | Germany . | |
| 4143274 | 8/1993 | Germany . | |
| 4137868 | 12/1993 | Germany . | |
| 5-231553 | 9/1993 | Japan | 137/625.64 |
| 2 254 909 | 10/1992 | United Kingdom . | |

*Primary Examiner*—Gerald A. Michalsky
*Attorney, Agent, or Firm*—Hoffmann & Baron

[57] ABSTRACT

A valve arrangement having a base plate with valve ducts, a main valve a pilot valve with actuating units. In order to obtain a compact design, the base plate constitutes the housing of the main valve and contains a valve spool receiving space with an associated valve spool. The base plate is divided into a central part and two connection parts mounted on opposite ends thereof, which connection parts constitute both a end cover for the valve spool receiving space and also a limb, which delimits an accommodation space for the actuating units. When the connection parts are removed the actuating units and the valve spool may be fitted in an extremely simple fashion.

16 Claims, 1 Drawing Sheet

VALVE ARRANGEMENT

BACKGROUND OF THE INVENTION

The invention relates to a valve arrangement comprising at least one valve unit possessing a main valve and at least one pilot valve for operation of such main valve and fitted with an electrically operated actuating unit, a base plate for such valve unit, such base plate having two limbs extending to the same side and delimiting an accommodation space, valve ducts extending in said base plate, such valve ducts including at least one supply duct, at least one venting duct and at least one power duct, said valve ducts being in communication with a valve spool receiving space of the main valve, and a spool of said main valve able to be moved axially between different switching positions in said valve spool receiving space.

THE PRIOR ART

A valve arrangement of this type is disclosed in the German patent publication 4,143,274 A1. It comprises several valve units each having a base plate through which supply and venting ducts extend. Two limbs, projecting upward from the end of the base plate, delimit a receiving space, wherein a main valve is arranged. For the control of same there are pilot valves set in the base plate.

Since the supply and venting ducts extend at a relatively large distance from the main valve, for connection with the valve spool receiving space special connecting ducts are required, which result in there being relatively long air paths and limit the possible flow rate. Furthermore there are limits as regards reduction in the overall size owing to predetermined dimensions of the main valves to be employed.

SHORT SUMMARY OF THE INVENTION

One object of the invention is to provide a valve arrangement of the type initially mentioned, which while possessing a compact form leads to there being short air paths and improved throughput values.

In order to achieve such aim the base plate constitutes the housing of the main valve and contains the valve spool receiving space with the valve spool, the base plate is divided into a central part and two terminal parts mounted on the opposite end surfaces of the central part, each terminal part constituting both an end cover for the valve spool receiving space and also one of the limbs delimiting the accommodation space, and furthermore at least one section of a pilot duct extends in the terminal parts, such pilot duct opening into the accommodation space at the associated limb, in which space at least the actuating units of the pilot valves present are arranged.

It is in this manner that the base plate and the main valve practically come to constitute an integral component. This more particularly renders it possible to arrange the supply and venting ducts present in the direct vicinity of the valve spool receiving space so that short air paths result and high throughflow rates may be produced. At the same time there is a compact design, and terminal parts mounted at the end, when removed from the central part, lead to good accessibility of the valve spool receiving space for fitting the valve spool. Since the limbs delimiting the accommodation space are also a component of the terminal parts, the accommodation space is readily accessible after removal of the cover parts so that the actuating units for the pilot valves may be installed without any trouble. Furthermore there is the advantage that the limbs constituted by the cover parts are employed to at least partially receive the pilot ducts, something which renders possible an optimum connection with the pilot valves.

Valve arrangements with individual valve units, in the case of which switching valves are integrated in a base plate are known as such. In this respect attention should be given to the German patent publication 3,510,283 A1, the European patent publication 0 116 500 A1, the German patent publication 3,919,413 A1 or the German patent publication 3,701,211 A1. In all such cases the actuation of the valve spool is however performed mechanically and without special pilot valves. Moreover, the assignee, as a matter of practical experience is aware of valve arrangements, in which additional pilot valves are provided. However such valves are directly screwed on at the sides so that there is a large overall width.

Further advantageous developments of the invention are defined in the claims.

It is an advantage if the central part of the valve unit possesses a projection extending into the accommodation space and constituting a partition dividing the accommodation space into two individual spaces of which each is suitable for receiving at least the actuating unit of a pilot valve. It is in this manner that the actuating units of both pilot valves may be mounted separately and independently from each other. If only one pilot valve is required, the second actuating unit is not required and may for example be replaced by a correspondingly formed dummy. The partition is furthermore suitable for the integration of a pilot venting duct, via which the vented air from the pilot valves present may be jointly let off.

The actuating units are preferably secured in place as part of a plugged mounting system without screws on the base plate. When the terminal parts are removed it is possible for the actuating units to be plugged to the partition and on mounting the terminal parts there is automatically a plugged connection with the same.

A further reduction of the structural complexity is possible if the seats of the pilot valves are integrated in the limbs of the terminal parts.

The supply and venting ducts integrated in the base plate, be they for the main valve or be they for the pilot valves, preferably extend through the base plate in the transverse direction so that it is possible to arrange several valve units as a battery side by side in order to provide block-like valve arrangements of any desired overall size, which have available a common supply and venting means for the operation thereof with the power fluid. The respective through ducts are preferably collected together in the central part so that no ducts are necessary in the terminal parts.

Further advantageous developments and convenient forms of the invention will be understood from the following detailed descriptive disclosure of one embodiment thereof in conjunction with the accompanying drawings.

LIST OF THE SEVERAL VIEWS OF THE FIGURES.

DETAILED ACCOUNT OF ONE WORKING EMBODIMENT OF THE INVENTION.

Figure 1:
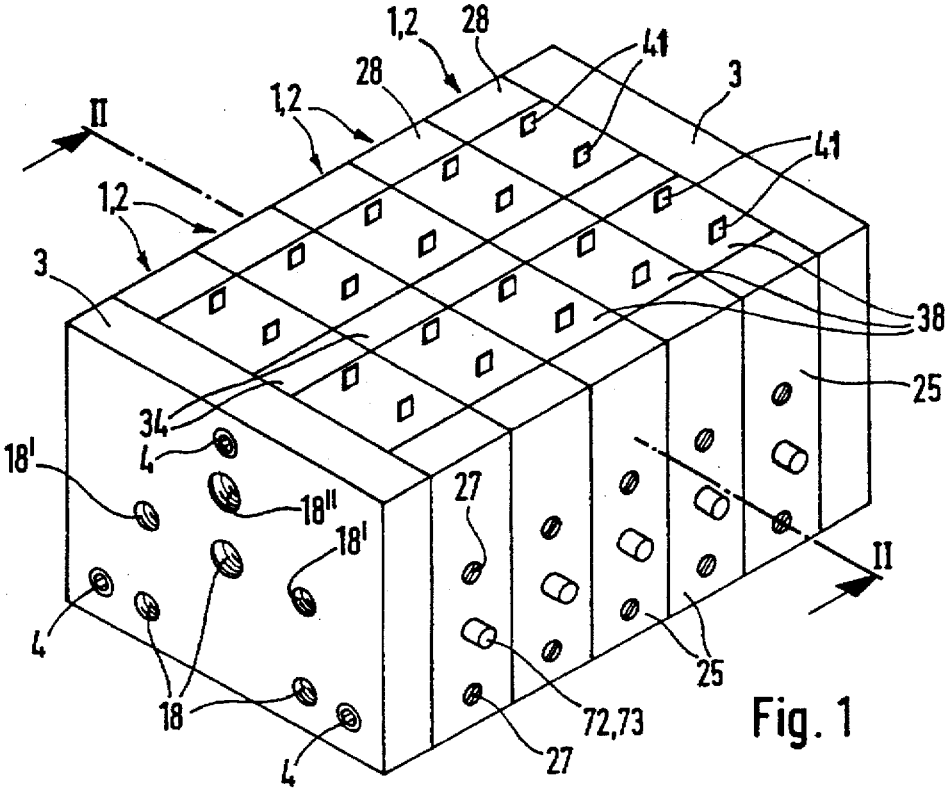
FIG. 1 shows a block-like valve arrangement in perspective composed of several valve units.

The valve arrangement indicated in FIG. 1 comprises a plurality of individual valve units 1, which possess a tabular or plate-like form with an at least substantially rectangular outline and consequently may be termed valve plates 2. Adjacent valve plates 2 are stacked with their major sides together. The two last valve plates 2 are followed by a similarly shaped end plate 3. All plates are clamped together by a plurality of ties 4, which for instance extend through all plates. The overall valve arrangement possesses an extremely compact, rectangular block-like form.

The number of the valve units 1 employed for a valve arrangement is variable. It would be even conceivable to design the valve arrangement with but a single valve unit, which is flanked on each side by an end plate 3 or which as such comprises all necessary wall parts so that no additional end plates would be required.

The reader will see in figure I the preferred design for the valve unit 1 as employed in the valve arrangement illustrated in FIG. 1. It is a question of a base plate unit, the longitudinal section indicated being parallel to the plane of the plate and accordingly extending to the two major plate surfaces.

The valve unit 1 comprises a main valve 5 and two pilot valves 6 serving for operation or control thereof. Together with a base plate 7 the main valve 5 constitutes a single structure. The base plate 7 forms the housing of the main valve 5.

In the base plate 7 a preferably cylindrically formed valve spool receiving space 8 is provided, which extends in parallelism to the plane of the plate in the longitudinal direction of the plate. In the valve spool receiving space 8 a valve spool 12, which for example is of piston-like configuration, is arranged, which is able to be moved between different switching positions axially, two possible switching positions being indicated above and underneath the longitudinal axis 13, marked in broken lines, of the valve spool receiving space 8.

In the base plate 7 a plurality of valve ducts 14 extend, same opening into the valve spool receiving space 8 with an axial distance therebetween peripherally. For instance it may be a question of central supply duct 15, two power ducts 16 flanking same axially and a venting duct 17 following each power duct 16. Accordingly the main valve 5 of the example is a 5/2 way valve or a 5/3 way valve.

The supply duct 15 and the two venting ducts 17 extend transversely and more particularly at a right angle to the valve plate plane so that they extend through the base plate 7 in the transverse direction and accordingly in the direction of the array to be seen from FIG. 1. It is in this manner that the individual supply and venting ducts 15 and 17 of the adjacently placed valve units 1 communicate with each other and constitute integral linking ducts, which communicate with connection openings 18 provided in one of the end plates 3. The openings 18 can be connected with pressure fluid lines going to other parts of the system and which supply and/or remove a power fluid such as compressed air. The second end plate 3 may be a simple cover plate without connection openings, even though it would be readily possible to provide connection openings on one or on both of the end plates 3 and possibly to shut off the one not required by means of a plug.

Between respectively adjacent plates 2 and 3 there is preferably a seal arrangement, not illustrated in detail, which prevents the escape of power fluid. Each seal arrangement may comprise a plurality of separate, individual seals, but will preferably comprise a single-piece, composite gasket which seals off all necessary sites.

The power ducts 16 of a respective valve unit 1 open at a common longitudinal marginal surface 22 of the base plate 7, which in the present working embodiment faces downward. At the opening part terminal threads 23 or plug connecting means, not illustrated in detail, are arranged, which render possible the connection of fluid power duct for a load, as for example a fluid power cylinder.

The base plate 7 is essentially made up of three plate elements, that is to say a central part 24 and two connection parts 25, the latter being preferably detachably mounted on opposite axial end surfaces 26 of the central part 24. The attachment is in the working embodiment respectively by means of one or more attachment screws 27, which extend through the respective terminal part 25 and are screwed into a screw threaded hole in the base plate 7.

Each terminal part 25 has a part constituting a limb 28 of the base plate 7 over the second longitudinal marginal surface 32 opposite to the already mentioned lower first longitudinal marginal surface 22 of the central part 24. Both of the limbs 28 consequently point the same way, in the present case upward. Between the two limbs 28 there is hence an accommodation space 33, which is preferably divided by a partition 34 into two mutually separate individual spaces 35 and 36. The partition 34 is formed by a projection 37 extending from the second longitudinal marginal surface 32 into the accommodation space 33, of the central part 24, which is preferably connected integrally with the central part 24. The height of the partition 34 is preferably the same as the that of the limbs 28 so that there is a termination at the same level. Each individual space 35 and 36 is open both laterally—toward the two major opposite surface—and also toward the top side opposite the central part 24. In the case of a battery-like array of the type indicated in FIG. 1 the individual spaces of the adjacent valve units 1 directly adjoin one another. The individual space of the last valve units 1 in the array are covered by the end plates 3. In an upward direction the individual spaces 35 and 35 are open.

With each individual space 35 and 36 a pilot valve 6 is associated. These pilot valves 6 are provided with an electrically operated actuating unit 38, as for example in the form of a electromagnet arrangement or solenoid. Both of the pilot valves 5 are integrated in the valve plate 2, an actuating unit 38 being at least substantially completely taking up one respective one of the individual spaces 35 and 36. In the working embodiment the actuating unit 38 possess a block-like configuration, and is more particularly a rectangular block so that the individual spaces 35 and 35 are completely filled thereby. In the case of a battery-like arrangement in accordance with FIG. 1 it is therefore possible for the actuating units 38 of adjacent valve units 1 to have their side surfaces in engagement with one another. This ensures an optimum utilization of the space available. The external surface 42 of the actuating units 38, which faces away from the central part and in the example is directed upward is at the same level as the terminal surfaces of the partition 34 and of the two limbs 28 so that there is generally an undivided and practically plane surface. At the external surface 42 each actuating unit 38 possesses at least one electrical connection contact 41, via which the electrical control signals, as required for the operation of the actuating units 38, may be supplied.

Each pilot valve 6 possesses a moving valve member 43, which is able to be switched by the associated actuating unit 38. For example, the valve member 43 is connected with a moving armature (56) of the associated actuating unit 38 or is constituted by such armature. The valve member 43 is located on the side, facing the associated limb 38, of the respective actuating unit and cooperates with a valve seat 44, which is directly formed on the associated limb 28. Dependent on the state of excitation of the actuating unit 38 the valve seat 44 is closed or opened by the valve member 43.

Each valve seat 44 is placed in a pilot duct 45 extending in the interior of the associated terminal part 25. This pilot duct communicates at one end with a pilot supply duct 46 in the central part 24 and at the other end with the end section 47 facing the respective terminal part 25, of the valve spool receiving space 8. Each is preferably provided with its own associated pilot supply duct 46 in the central part 24, same for example flanking the supply duct 15 and like same extending right through the central part 24 in a transverse direction. In the battery-like arrangement in accordance with FIG. 1 the pilot supply ducts 46 on each side complement each other to form linking ducts, which are accessible through communicating connection openings 18' on at least one of the end plates 3 in order to be able to supply pilot fluid.

While it would be possible to draw the pilot fluid from the supply duct 15, the separate design does however render possible a pilot action independent of the main valve supply pressure.

The section 45' of the pilot duct 45 connected with the pilot supply duct 46 opens through the valve seat 44 into the accommodation space 33 or, respectively, the respectively associated individual spaces 35 and 36. The other end of such duct section 45' opens toward the associated end 26 of the central part 24, where it is aligned with a connection duct 48, an intermediate seal being placed between them, such connection duct 48 opening laterally into the pilot supply duct 46. The second duct section 45" leading to the end section 47 of the valve spool receiving space 8, of the pilot duct 45 also opens into the associated individual space 35 and 36, the corresponding opening 52 in the working embodiment being located on the periphery of a recess 53 open toward the individual space 35 and 36. The valve seat 44 is provided on the floor of such recess 53. The valve member 43 extends into the recess 53.

If the valve member 43 is lifted clear of the valve seat 44, fluid under pressure will pass from the associated pilot supply duct 46 via the open pilot duct 45 into the end section 47 of the valve spool receiving space 8 and will act on an axially moving actuating element 54 in such end section 47, such element being functionally connected with the associated end section of the valve spool 12 or directly constitutes such end section. The actuating elements 54 at each end are in the working embodiment actuating pistons. Owing to the action of pressure the actuating element 54 will be displaced with the result that the valve spool 12 will change its position of switching.

If the passage through one of the two pilot ducts 45 is so opened that the other pilot duct 45 of the opposite terminal part 25 is preferably closed by suitable operation of the associated pilot valve 6. The associated end section 47 of the valve spool receiving space 8 is in this case vented through the second duct section 45", the recess 53 and the actuating unit 38 into a pilot venting duct 55. The latter extends in the partition 34 and like the pilot supply ducts 46, extends through the central part 24. The pilot venting ducts 55 of joined together valve units 1 add together to form a common duct, which is termed a linking duct, and which opens into a connection opening 18" at one of the end plates at least. From this point the spent air may be jointly removed if required via a pressure fluid duct, to be connected here.

Preferably a single common pilot venting duct is provided for both pilot valves 6, such duct being in communication with both individual spaces 35 and 36 via connection ducts 65 and accordingly renders possible a connection of the actuating units 38.

In FIG. 1 in the actuating unit on the right the internal duct arrangement is indicated in broken lines. The reader will see the armature 56 acting of the valve member 43*a* duct 57 being provided in the form of a gap, such duct 57 being open all the time toward the recess 53. The end of the armature 56, which is opposite to the valve member 43, possesses a valve member 58, which is opposite to a valve seat 59, which is followed by discharge duct 60. The valve seat 59 is placed between the duct 57 and the discharge duct 60, the latter communicating with the pilot venting duct 55. If the first valve seat 44 is shut off the above mentioned second valve seat 59 will be cleared and will render possible venting of the second duct section 45" via the duct 57 and the discharge duct 60 into the pilot venting duct 55. In the other switching position of the armature 56 the second valve seat 59 will be closed with the result that the pilot fluid will flow via the open first valve seat 44 into the second duct section 45".

The two actuating units 38 are preferably exclusively secured in the individual spaces 35 and 36 by means of plug connections in an interlocking, unlosable fashion. Thus assembly is possible without screws and in a simple manner. For instance each actuating unit is pluggedly connected both with its associated limb 28 and also with the partition 34. For this purpose on the respective external surfaces of the actuating units 38 there is respectively at least one projection 63 and 64. The projection 63 on the limb side fits in an interlocking manner into the recess 53. The projection 64 on the partition side extends into a recess, which is conveniently formed by the associated connecting duct 65, which at one end opens into the pilot venting duct 55 and at the other end opens into an associated individual space 35 and 36. The first mentioned projection 63 preferably extends axially around the valve member 43 and/or the armature 56. The other projection 64 preferably has the discharge duct 60 extending through it, which opens into the pilot venting duct 55. At the individual plug connections sealing elements are preferably provided.

After removal of the terminal parts 25 the valve spool receiving space 8 is open at the end, since the terminal parts 25 perform a cover function. Simultaneously however the individual space 35 and 36 are accessible from their ends, since the limbs 28 are removed. It is therefore possible to fit the valve spool 12 and the actuating units 38 without any difficulty. The latter are fitted in place in the individual space 35 and 36 open and their ends until their projections 64 fit into the recesses 64. Then the terminal parts 25 are put in place, the projections 63 partly fitting into the recesses 65.

In the valve spool receiving space 8 annular sealing units 66 are provided for cooperation with the valve spool 12. Preferably they respectively consist of an annular housing 67 with a U-like cross section, which accepts and holds at least one rubber-elastic seal ring 68, such ring surrounding the valve spool 12. The individual seal units 66 are locked in place by way of their housing 67 in the desired position within the valve spool receiving space 8 with a press fit. Fitting may be performed without any trouble with the terminal parts 25 removed.

Figure 2:
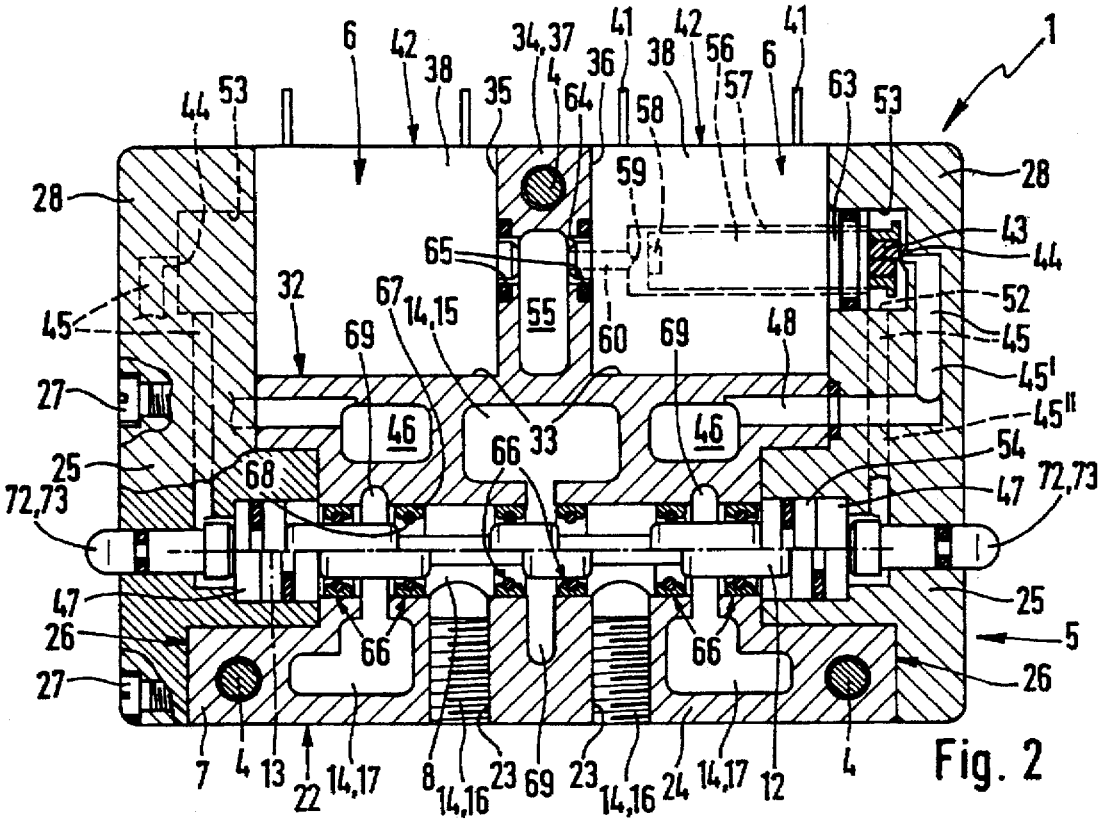
FIG. 2 is a longitudinal section taken through one of the valve unit, employed in the valve arrangement of FIG. 1 on the section line II—II.

As shown in FIG. 2, the terminal parts 25 can readily form the end sections 47 of the valve spool receiving space 8, wherein the actuating elements 54 are housed.

In order to ensure an optimum flow through the main valve in the working embodiment the supply duct 15 and the two venting ducts 17 are so designed and arranged that one part 69 of their cross section extends through the valve spool receiving space 8 transversely. The result of this is that the fluid under pressure does not firstly flow within a respective valve unit 1 via a branch duct into the valve spool receiving space and flow out of it, but rather that the valve spool receiving space 8 has fluid passing transversely through it adjacent to the above mentioned parts 69 of the duct cross sections. Since the main valve 5 is integrated in the base plate 7, the design of the individual valve ducts may be adapted ad hoc without any trouble.

In the working embodiment adjacent to the two connecting parts 25 it is possible to provide a respective manual actuating device 72 for the main valve. In the present case it is a question of actuating plungers 73, which extend through a respective terminal part 25 and have an actuating part extending outward. If an actuating plunger 73 is manually thrust inward, it will act on the associated actuating element 54 so that the valve spool 12 is changed in position.

It would also be possible to provide both manual actuating devices 72 jointly on a terminal part 25 so that in either case operation from one end is possible. The opposite end would then be fully available for attachment of the valve arrangement on a support structure.

We claim:

1. A valve arrangement comprising at least one valve unit possessing a main valve and at least one pilot valve for operation of such main valve and fitted with an electrically operated actuating unit, a base plate for such valve unit, such base plate having two limbs extending to the same side and delimiting an accommodation space, valve ducts extending in said base plate, such valve ducts including at least one supply duct, at least one venting duct and at least one power duct, said valve ducts being in communication with a valve spool receiving space of the main valve, which receives a valve spool of said main valve able to be moved axially between different switching positions, wherein the base plate forms the housing of the main valve and contains the valve spool receiving space with the valve spool, the base plate is divided into a central part and two terminal parts mounted on the opposite end surfaces of the central part, each terminal part constituting both an end cover for the valve spool receiving space and also one of the limbs delimiting the accommodation space, and furthermore at least one section of a pilot duct extends in the terminal parts, such pilot duct opening into the accommodation space at the associated limb, in which space at least an actuating unit of the at least one pilot valve is arranged, wherein the central pan of the valve unit possesses a projection extending into the accommodation space, such projection constituting a partition dividing the accommodation space into two individual spaces, each individual space being suitable for receiving at least the actuating unit of the at least one pilot valve.

2. The valve arrangement as set forth in claim 1, wherein a pilot venting product extends in the partition and opens towards the two individual spaces and is in communication with the respectively present pilot valve.

3. The valve arrangement as set forth in claim 1, wherein the respective actuating unit is connected by plug means both with the partition and also with the respectively associated limb and accordingly is held in a unlosable manner in the respective individual space.

4. The valve arrangement as set forth in claim 3, wherein each actuating unit possesses a projection on the external sides facing the partition and the limb, such projection fitting into a recess in the partition or, respectively, in the limb.

5. The valve arrangement as set forth in claim 1, wherein each valve unit, in its state fitted with solenoid valves, forms a multi-part valve plate having a rectangular outline, which valve plate has recesses forming the individual spaces of the accommodation space on one longitudinal side.

6. The valve arrangement as set forth in claim 5, wherein on a longitudinal marginal surface, opposite to the accommodation space, the valve plate includes openings for the power duct.

7. The valve arrangement as set forth in claim 1 wherein each such actuating unit is so arranged in the accommodation space that its external surface provided with electrical connecting contact is turned away from the central part.

8. The valve arrangement as set forth in claim 1, wherein seats of the at least one pilot valve are formed in the limbs of the terminal parts.

9. The valve arrangement as set forth in claim 1, wherein each such terminal part constitutes an end section of the valve spool receiving space, in which an actuating element is arranged for the valve spool.

10. The valve arrangement as set forth in claim 1, wherein the valve spool receiving space is cylindrically formed and comprises a plurality of seal units pressed into position with an axial spacing, such seal units having an annular housing secured in the valve spool receiving space and at least one elastic seal ring held in the housing.

11. The valve arrangement as set forth in claim 1, wherein the at least one supply duct and the at least one venting duct are formed in the central part of the at least one valve unit and extend through same transversely in relation to the plane of the base plate.

12. The valve arrangement as set forth in claim 11, wherein the central part has extending through it, in a direction perpendicular to the plane of the plate, at least one pilot supply duct communicating with the at least one pilot duct.

13. The valve arrangement as set forth in claim 11, comprising several such valve units placed in an array side by side, whose respective transversely extending supply ducts and venting ducts and pilot supply ducts are in communication with one another.

14. The valve arrangement as set forth in claim 11, wherein the at least one supply duct and the at least one venting duct so extend in the central part that they have at least a part of their duct cross section extending through the valve spool receiving space.

15. The valve arrangement as set forth in claim 11, further comprising two end plates, between which the at least one valve unit is arranged, at least one of the end plates having connection openings which communicate with the transversely extending valve ducts of the at least one valve unit.

16. A valve arrangement comprising:

a housing for a valve unit, the valve housing including a valve receiving space and a valve unit positioned therein, the valve housing having a base portion including a central part and two terminal parts mounted on opposite end surfaces of the central part each terminal part providing an end cover for the valve receiving space and including a vertical extent which extends above the valve receiving space, the vertical extents defining therebetween an accommodation space for at least one control valve, wherein at least a portion of a control duct extends in the terminal parts and opens into the accommodation space, the central part of the base portion having a projection extending into the accommodation space the projection dividing the accommodation space into two receiving spaces, each receiving space being adapted for receiving at least an actuating unit of a control valve.

* * * * *

UNITED STATES PATENT AND TRADEMARK OFFICE

CERTIFICATE OF CORRECTION

PATENT NO. : 5,666,994
DATED : September 16, 1997
INVENTOR(S) : Stoll et al.

It is certified that error appears in the above-indentified patent and that said Letters Patent is hereby corrected as shown below:

In Column 4, Line 36, the patent now reads "35 and 35"; should read --35 and 36 are open--.

In Column 4, Line 46, the patent now reads "spaces 35 and 35"; should read --spaces 35 and 36--.

In Column 7, Line 47, the patent now reads "central pan"; should read --central part--.

Signed and Sealed this

Ninth Day of December, 1997

*Attest:*

*Attesting Officer*

BRUCE LEHMAN

*Commissioner of Patents and Trademarks*